US007310836B2

(12) United States Patent
Glunk

(10) Patent No.: US 7,310,836 B2
(45) Date of Patent: Dec. 25, 2007

(54) UNIT FOR MOUNTING PLUMBING FIXTURES

(75) Inventor: Guenther Glunk, Fluorn-Winzeln (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 10/433,934

(22) PCT Filed: Aug. 14, 2002

(86) PCT No.: PCT/EP02/09084

§ 371 (c)(1),
(2), (4) Date: Jul. 2, 2003

(87) PCT Pub. No.: WO03/027403

PCT Pub. Date: Apr. 3, 2003

(65) Prior Publication Data

US 2004/0049843 A1 Mar. 18, 2004

(30) Foreign Application Priority Data

Sep. 21, 2001 (DE) ..... 101 48 900

(51) Int. Cl.
*A47K 3/20* (2006.01)

(52) U.S. Cl. ..... 4/570; 4/605; 4/615

(58) Field of Classification Search ..... 4/570, 4/567, 615, 606, 601, 605; 248/477, 297.21, 248/295.1; 239/282
See application file for complete search history.

(56) References Cited

U.S. PATENT DOCUMENTS

| | | | | |
|---|---|---|---|---|
| 2,685,093 A | | 8/1954 | Lundquist | |
| 3,806,963 A | | 4/1974 | Flynn | |
| 4,360,159 A | * | 11/1982 | Haynes | 4/605 |
| 4,561,136 A | * | 12/1985 | Baer | 4/615 |
| 5,857,227 A | * | 1/1999 | Trusty et al. | 4/615 |

FOREIGN PATENT DOCUMENTS

| | | |
|---|---|---|
| CH | 4 53 237 | 6/1968 |
| DE | 11 66 707 | 10/1964 |
| DE | 72 33 907 | 3/1973 |
| DE | 26 01 059 | 7/1977 |
| DE | 79 08/437 | 8/1979 |
| DE | 79 21 329 | 10/1979 |
| DE | 81 30 060 | 2/1982 |
| DE | 44 29 357 | 5/1996 |
| DE | 196 41 337 | 4/1998 |
| DE | 199 44 791 | 8/2001 |
| EP | 0 076 906 | 4/1983 |
| EP | 0 698 694 | 8/1985 |
| EP | 0 555 641 | 8/1993 |

OTHER PUBLICATIONS

International Search Report.
European Search Report.

* cited by examiner

*Primary Examiner*—Khoa D. Huynh
(74) *Attorney, Agent, or Firm*—Duane Morris LLP

(57) ABSTRACT

It is proposed that a profiled section that, subsequent to its fabrication, has a channel that is fully enclosed on all sides be employed for holding hygienic articles. The channel is arranged on the rear of a front wall of the profiled section such that will be initially concealed from view. The channel borders on the front wall of the profiled section. Incorporating a slot into the front wall of the profiled section will open the channel over a certain portion of its length. A hygienic article may be held in place in the resultant undercut slot.

25 Claims, 3 Drawing Sheets

UNIT FOR MOUNTING PLUMBING FIXTURES

Figure 1:
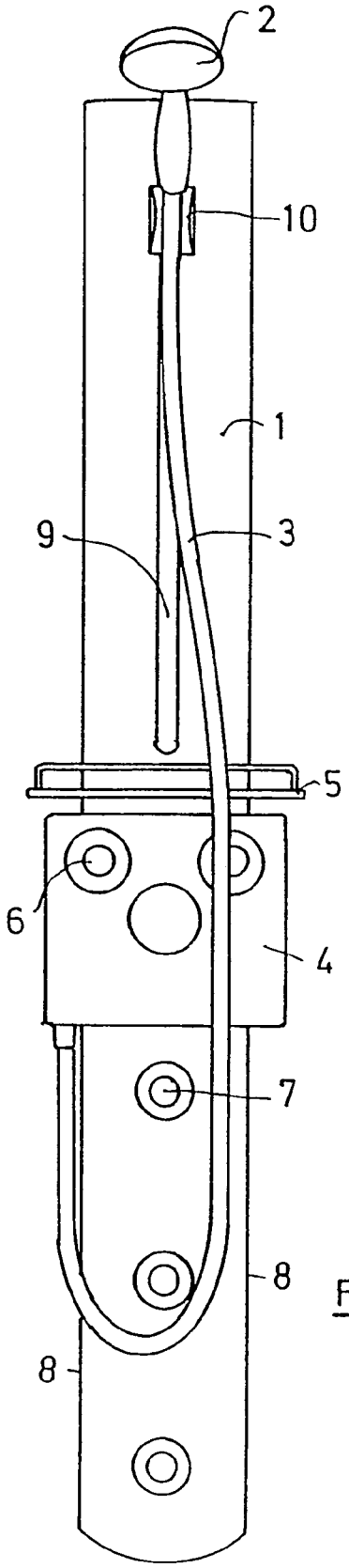

The invention relates to an installation unit for plumbing fixtures, in particular, for holding hygienic articles, which might, for example, be a holder for a shower head that might, if desired, also be mounted such that the height of the shower head will be adjustable. Other articles that might be, or are to be, mounted thereon are shelves, holders for toothbrush glasses, or similar.

A shower-head holder that employs an elongated profiled section is already known (cf. German Patent DE 7908437 U). The profiled section has a longitudinal slot in its front wall that extends over its full length and merges into a semicircular channel on the inner surface of the profiled section. A rider on which a hand-held shower head may be mounted fits into the slot and may be slid along the slot. The profiled section is open at the rear and may be mounted on a wall.

A device for holding a shower head or hand-held shower head such that its vertical position may be continuously adjusted is also known (cf. German Patent DE 7921329 U). That device has a profiled section whose cross-section resembles that of a straight strip having a channel having a rectangular-cross-section attached to its outer surface. A slot in the front wall of the channel extends through the strip. A holder extends through the slot and grips the inner walls of the channel.

A device for arranging a shower head such that its height may be adjusted, where the shower head may be slid along a vertical rod mounted on a wall, is also known (cf. German Patent DE 2601059). The rod has a rear slot through which the holder for the shower head is fastened to a rider arranged inside the rod.

In the case of another, known, shower unit having a shower head whose height is adjustable (cf. U.S. Pat. No. 3,806,963), a holder for the shower head is arranged inside a section of hollow, profiled stock such that it may be slid along the section of hollow, profiled stock. A hose is arranged inside the section of hollow profiled stock.

The problem addressed by the invention is creating a simply designed and inexpensive-to-manufacture holder for hygienic articles that may be adapted to suit the requirements of individual installations subsequent to its manufacture.

In order to solve that problem, the invention proposes a holder having those features stated in claim 1. Elaborations of the invention are covered in the subclaims.

The opening, which may be elongated, in the front wall of the section of profiled stock that will be present when the installation unit has been final-manufactured allows accessing the channel arranged in the interior of the section of profiled stock. Various articles, which may protrude outward, through the opening, may be attached to the channel.

The channel may transport water. Water lines may be connected to its ends or front or rear walls.

Once the installation unit has been final-manufactured, the profiled outer surface of its profiled section will have at least one opening providing access to the channel arranged on the rear of its profiled outer surface. The opening may be used for attaching a hygienic article. The opening may be a small opening that, for example, will be totally obscured by the hygienic article. However, it may also be a longitudinal slot extending along the length of the profiled section that may be used for holding one or more shower heads or overhead shower heads.

In accordance with the invention, an elaboration thereof may provide that the opening extends over only part of the length of the profiled section.

In accordance with the invention, it may also be provided that the profiled section is assembled from at least two profiled sections arranged end to end, in which case, the opening may be arranged on either one or the other of the profiled sections, or, of course, on both of them.

In accordance with the invention, it may be provided that the slot extends over the full length of the profiled section once the profiled section has been final-manufactured or extends over the full length of the profiled section and is subsequently closed over part of its length by at least one cover. An opening that extends only over part of the length of the profiled section and/or installation unit may be created in this manner. Of course, several openings may also be created in this manner.

The cover employed for limiting the length of the opening may, for example, be mounted on the outer surface of the profiled section.

However, it will also be feasible, and is proposed by the invention, to provide that the cover will be in the form of a strip, a rod, or similar inserted into the channel from, for example, its front edge. Part of this strip may then form the cover that closes the slot with within. In particular, the cover may be a rod that totally fills the cross-section of the channel.

An elaboration of the invention may provide that the channel is fully enclosed on all sides over the full length of the profiled section when the profiled section has been final-manufactured and the opening created later by, for example, machining or using a grinder.

In this latter case, the profiled section is initially fabricated such that the channel remains fully enclosed on all sides and is open only at the upper and/or lower end of the profiled section. If the profiled section is to be installed at a certain location, then the visible side of its profiled surface will initially have no opening for the channel. The holder may thus be used such that no opening will be visible.

An elaboration of the invention may provide that the cross-section of the channel is shaped such that its lateral dimension initially increases beyond the bounding wall formed by the profiled surface, which may, for example, be provided for by providing that the channel has a semicircular cross-section that borders on the bounding wall of the profiled section.

In accordance with the invention, an elaboration of the invention may provide that the profiled section and the at least one channel are symmetrically arranged, which, in the case of a single channel, would mean, for example, that the channel is arranged midway between two lateral edges of the profiled section.

In order to mount a given hygienic article on the profiled section such that it may be removed, in accordance with the invention, it may be provided that the channel is opened by a slot in the profiled surface of the profiled section for accommodating the hygienic article extending over a certain portion of the length of the profiled section, where the slot may be very short if the height of the hygienic article does not need to be adjusted. However, the slot might also be long if facilities for mounting the hygienic article at various, continuously adjustable, heights are to be provided.

In accordance with the invention, it may be provided that the slot is undercut in order that the hygienic article may be clamped to the edges of the slot or clamped in the channel.

In particular, it may be provided that the hygienic article may be mounted such that it may be slid over the full length of the slot. Clamps that may be used for holding it in place or a tight fit may provide that the hygienic article will clamp itself in position due to a slight tilting of its rider in the channel due to its weight.

As mentioned above, the channel extends over the full length of the profiled section, which has the advantage that the profiled section may be simply fabricated by, for example, extrusion. It will thus be feasible to open the channel by means of solitary slots arranged at several locations, which will allow mounting various hygienic articles at various heights on the same channel.

In order to allow mounting an overhead shower head, it may be provided that at least one slot extends to the upper end of the profiled section. The overhead shower head may then, for example, be inserted into the channel from above and the upper end of the profiled section closed by a cap.

It will also be feasible, and is proposed by the invention, to provide that at least one slot has a broadened section for inserting a hygienic article that, for example, may be covered once the hygienic article has been inserted. It is also imaginable that a holder for a hygienic article might be shaped such that it may be inserted into a slot having no broadened section for inserting such, where its latching into position may then be provided by a spreading, tilting, or similar action after it has been inserted.

It has been mentioned above that a channel may be opened at several locations in order to allow mounting several hygienic articles. However, mounting and/or guiding a hygienic article in several channels will also be feasible and fall under the invention. For example, a shelf, which may be relatively wide, may be mounted on several, parallel channels, and may also be mounted such that its height will be adjustable, if desired.

If several slots are created, they may have differing widths.

When fabricating profiled sections having more than one channel, it may be provided that their channels have the same, or differing, profiles. It may also be provided that their channels and/or slots are arranged at various angles with respect to a reference surface on the profiled sections. For example, a mounting surface to be used for mounting the profiled sections on a wall may serve as that reference surface.

In accordance with the invention, an elaboration may provide that the profiled section is a hollow shell, where the channel is arranged in the interior of the hollow shell. Of course, it will also be feasible to configure the profiled section as an open shell, where, in this case, the channel will be arranged such that it is covered by a front wall following installation.

In accordance with the invention, the slots in the mounting surfaces may be used for accommodating seals, which will allow sealing the joints where the installation unit mates to the wall. However, the slots also be used for mounting hygienic articles, which may be somewhat longer and/or wider than the slots. Housing components for accommodating, for example, shower heads, may also be fastened in place there. Under some circumstances, fasteners for joining an installation unit to another installation unit may also be arranged in the slots on their mounting surfaces.

Figure 2:
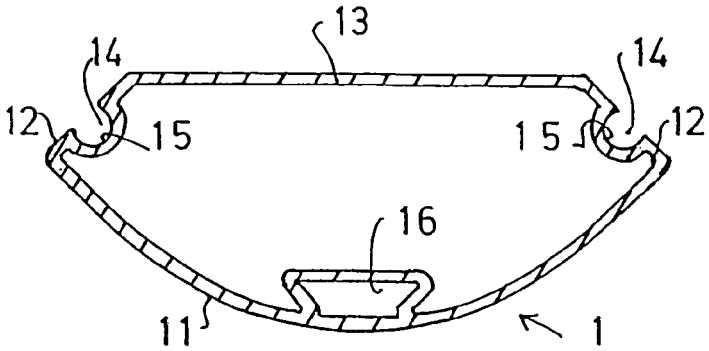
Figure 3:
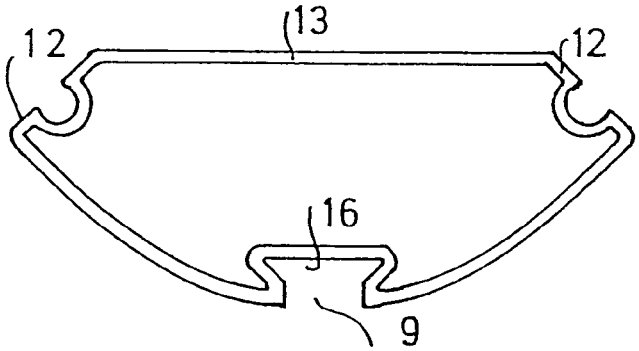
Figure 4:
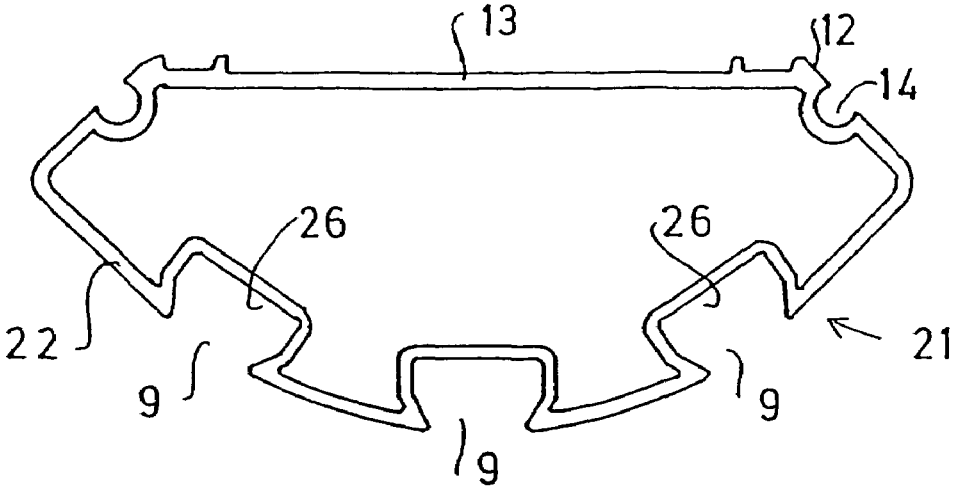
Figure 7:
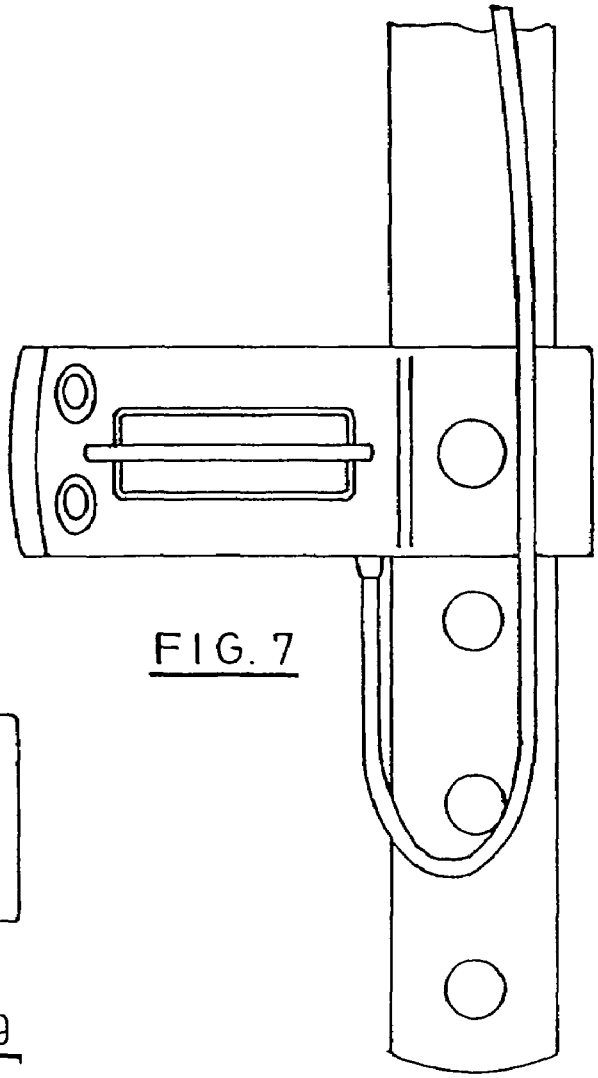
Figure 9:
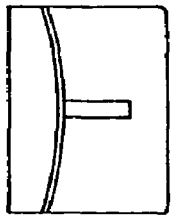
Figure 5:
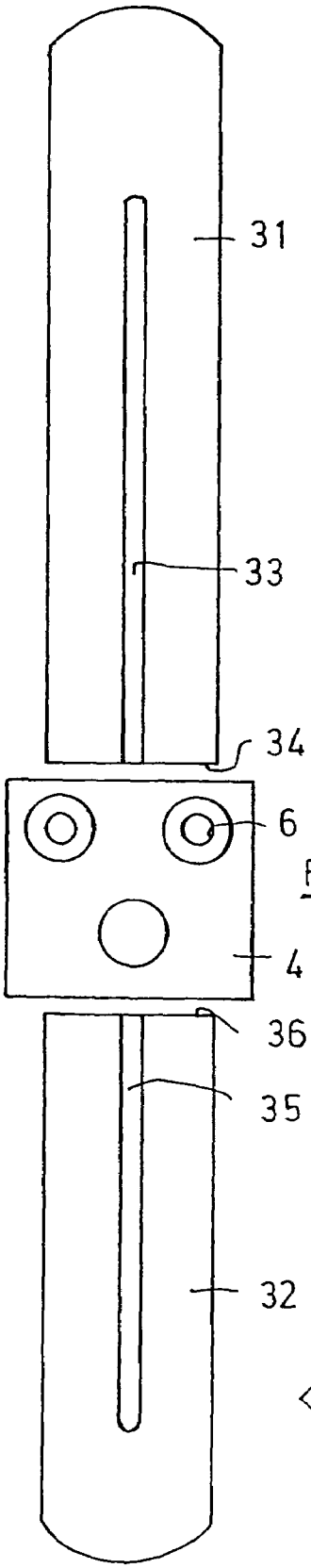
Figure 6:
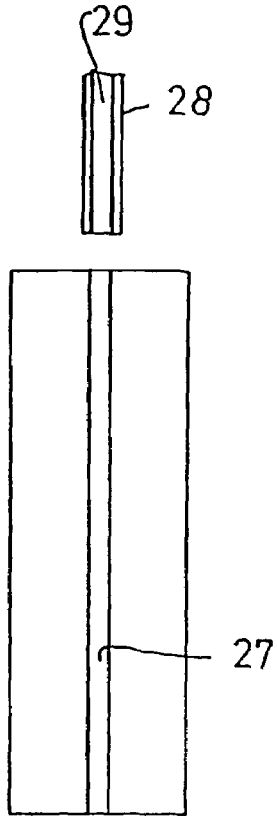
Figure 8:
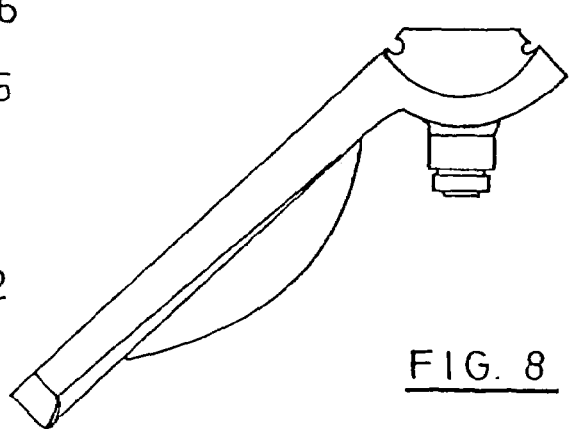

Other features, details, and benefits of the invention will be evident from the following descriptions of preferred embodiments of the invention and from the figures, where the figures depict:

FIG. 1 a frontal view of a fully assembled holder for an overhead shower head, several side-mounting shower heads, and a shelf;

FIG. 2 a section through profiled stock used for manufacturing such a holder;

FIG. 3 a section through that profiled stock at another location along its length;

FIG. 4 a top view of another type of profiled stock that may be used for manufacturing a holder;

FIG. 5 a frontal view of an arrangement for configuring an installation unit that employs a profiled section assembled from two profiled sections;

FIG. 6 a schematic depiction of a section of profiled stock;

FIG. 7 a frontal view of another embodiment;

FIG. 8 a top view of the arrangement shown in FIG. 7;

FIG. 9 a side view of part of the housing that is attached to the arrangement shown in FIG. 7.

FIG. 1 depicts a frontal view of a fully assembled holder for hygienic articles. The holder comprises an elongated, vertically oriented, profiled section 1 that may, for example, be installed in a corner where two walls meet. An overhead shower head 2 that is connected to an operating panel 4 by a shower hose 3 is mounted on its upper section. A shelf 5 that is wider than the profiled section 1 is mounted above the operating panel 4. Controls 6, for example, controls for switching between using the various shower heads, a knob for adjusting water temperature, and a knob for adjusting the openings in the shower heads, are arranged on the operating panel. Situated on the profiled section, below the operating panel 4, are several shower heads 7 arranged midway between two lateral edges 8 of the profiled section 1.

As may be seen from the view of FIG. 1, there is a longitudinal slot 9 on the upper section of the front wall of the profiled section 1 that terminates just above the shelf 5. A holder 10 for the overhead shower 2 in inserted into this slot 9 and may be moved up and down in the slot. Further details thereof have not been shown, since such fastening devices are well known.

Turning now to FIG. 2, FIG. 2 depicts the profiled section 1 as it appears immediately following its fabrication. The profiled section has a closed wall that, in the case of the particular example shown here, is in the shape of a convex arc. Its profiled outer surface 11 is bordered by a pair of mounting surfaces 12 that are disposed at a right angle whose apex lies behind the profiled section with respect to one another. The mounting surfaces 12 are joined to one another by a planar bounding wall 13 situated behind the visible, profiled, front surface 11, yielding a hollow shell. A longitudinal slot 14 that blends into a recess 15 that extends over the full length of the profiled section is formed in each of the mounting surfaces 12. This recess may be used for accommodating a cover while the holder is being shipped.

A channel 16 having a tubular profile that is fully enclosed on all sides is formed in the interior of the hollow shell, directly on the rear of the visible, front surface 11. This channel 16 is open only at both ends of the profiled section. A bounding wall of the channel 16, namely, its front wall, is formed by the profiled outer surface 11. The lateral dimension of the channel 16 increases with distance from this front surface, toward the center of the interior of the hollow shell, yielding a sort of swallow-tail-shaped cross-section for the enclosed channel 16.

The channel 16 may be opened by creating a slot 9 in the front wall 11 of the profiled section 1 that either extends over the full length of the profiled section or only over part of its length. FIG. 3 depicts a view in which the channel 16 has been opened by such a slot 9. The slot 9 has a width that equals the distance between the lateral walls of the channel immediately behind the bounding front wall 11 of the profiled section 1. The slot 9 is thus undercut. It would also be feasible to make the width of the slot less than the width of the channel, which would allow making the slot 9 narrower. This slot may, as shown in FIG. 1, extend only over part of the length of the profiled section. It may commence at one end of the profiled section or may be closed on both of its ends. The slot 9 (cf. FIG. 1) may be used for accommodating several hygienic articles, for example, the holder of a toothbrush glass as well, where holders that engage the walls of the slot 9 may also be asymmetric.

FIG. 4 depicts a view corresponding to that of FIG. 2 for another type of profiled section. Here as well, the profiled section 21 is in the form of a hollow shell having a pair of mounting surfaces 12 and a planar bounding wall 13. Three slots 9, each of which leads into a channel 26, have been created in its arced front wall 32. Of course, in this case as well, the slots 9 might extend only over part of the length of the profiled section. Elements form mounting, for example, the shelf 5 might be arranged in both of the outer slots 26. The center slot 26 could be used for mounting the overhead shower head. Here again, the slots 9 are undercut in order that holders may be mounted on the edges of the slots.

Both the profiled section of FIG. 2 and the profiled section of FIG. 4 are symmetric with respect to a central plane.

The profiled sections may be installed in the corner of a room, in which case, the surfaces 12 may be used for mounting them on the walls of the room. However, the profiled sections may also be mounted on the flat surface of a wall instead of in a corner, in which case, the slots 14 may also be used for installing holders that hold articles on the front surfaces of the profiled sections.

FIG. 5 depicts an embodiment where the installation unit has a profiled section that is assembled from two profiled sections 31, 32. In the case of the example shown, the upper profiled section 31 has a slot-shaped opening 33 that is open on its lower end 34. Conversely, the lower profiled section 32 has a slot 35 that is open on its upper end 36. Both profiled sections 31, 32 are arranged end to end and joined to the operating panel 4. Fittings for connecting lines leading to, for example, an overhead shower head situated in the slot-shaped opening 33 might be arranged on the operating panel. These lines might be routed in the channel over part of their lengths. The channel might also transport water.

FIG. 6 depicts, a greatly simplified view of a profiled section where the slot-shaped opening 27 extends over the full length of the profiled section. In this particular case, a limitation of the opening that opens out onto the profiled outer surface may be achieved by inserting a profiled rod 28 into the channel situated behind the opening 27 from one end. This profiled rod may have a cross-section that matches the internal cross-section of the channel, in which case, a fin 29 on the front side of the profiled rod 28 may cover the slot-shaped opening 27. The tip of the fin 29 may be flush with the profiled outer surface of the profiled section.

The embodiments depicted in FIGS. 7-9 illustrate another example of how the installation unit according to the invention may be configured and used. In this case, a housing component 30 that extends well beyond the lateral edges of the profiled section 31, instead of a relatively small and simple operating unit 4 (cf. FIG. 5), is mounted on the profiled section 31. The lateral wing of the housing component are angled such that its rear surface 41 lies in the same plane as the mounting surfaces 12. If the profiled section 31 is installed in a corner of a room, then the rear surface 41 of the lateral wing of the housing component 30 may contact the walls and be fastened there.

The front side of the housing component 30 is used for accommodating, for example, a shelf 42, but may also be used for accommodating a side-mounting shower head or operating controls for side-mounting shower heads. The housing component 30 may be mounted on the profiled section by, for example, providing a holder, on the rear wall of the housing component 30, which faces the front surface of the profiled section 31, that engages the slot therein, which is not shown in FIGS. 8 and 9. Since it is relatively large, this housing component 30 might also be hung in the slots 14 in the mounting surfaces 12.

Configuring a housing component similar to the housing component 30 such that the vicinities of both of its ends are suitably shaped for mounting it on a profiled surface 31 is feasible, and falls under the invention. An installation unit that has a pair of parallel, profiled sections could then be formed in the corner of a room or the corner of a shower stall using a pair of profiled sections 31.

The housing component 30 of the embodiment shown in FIGS. 7-9 is configured such that it may be mounted upside down, i.e., such that its wing would extend to the right in FIG. 7, instead of to the left, as shown in FIG. 7, which may be achieved by, for example, providing that fittings for connecting the shower hose may be installed on both its top and bottom.

Configuring a housing component 30 such that it has two lateral wings, which would then extend both to the left in FIG. 7 and to the right in FIG. 7, is also feasible, and falls under the invention.

What is claimed is:

1. An installation unit for plumbing fixtures that has at least one profiled section for holding and attaching at least one hygienic article, wherein the profiled section is extruded and defines over a full length of said extruded profiled section a profiled surface on its front side, and at least one channel formed in the profiled section, wherein the channel extends continuously over the full length of said extruded profiled section behind the profiled surface and has a cross-section that borders on the profiled surface, wherein an opening formed through the profiled surface into the channel defines a longitudinal slot that opens the channel out onto the profiled surface, wherein the channel is closed behind the front side on all sides over the full length of the profiled section and is open at both ends of the profiled section, and wherein the opening through the profiled surface into the channel extends only over part of the length of the profiled section so that over another part of the length of the profiled section, the front side of the profiled section is closed over the channel.

2. An installation unit according to claim 1, wherein the profiled section is assembled from at least two profiled sections that are arranged end to end.

3. An installation unit according to claim 1, wherein the cross section of the channel is shaped such that its lateral dimension initially increases beyond the bounding wall formed by the profiled surface.

4. An installation unit according to claim 1, wherein the profiled section and channel are symmetrically arranged.

5. An installation unit according to claim 1, wherein the channel is arranged to accommodate a hygienic article and is opened by a slot in the profiled surface over a certain portion of its length.

6. An installation unit according to claim 5, where in the slot is undercut.

7. An installation unit according to claim 5, wherein the hygienic article is held in the channel such that it may be slid along the full length of the slot opening the channel.

8. An installation unit according to claim 5, wherein the channel is opened by solitary slots at several locations.

9. An installation unit according to claim 5, wherein at least one said slot extends through an outer surface of the profiled section.

10. An installation unit according to claim 1, wherein a hygienic article may be held and guided in more than one channel.

11. An installation unit according to claim 1, having several slots with differing widths.

12. An installation unit according to claim 1, having several channels with differing profiles.

13. An installation unit according to claim 1, wherein at least one of the channels and slots have angles that differ from those of a bounding surface of the profiled section.

14. An installation unit according to claim 13, wherein the profiled section has at least one mounting surface for mounting the installation unit on a wall.

15. An installation unit according to claim 14, wherein at least one said mounting surface has longitudinal slots extending over its full length.

16. An installation unit according to claim 15, wherein seals are arranged in the slots in the mounting surface.

17. An installation unit according to claim 1, wherein the profiled section comprises a hollow shell and the channel is arranged in an interior of the hollow shell.

18. An installation unit according to claim 1, wherein one hygienic article comprises a shower head.

19. An installation unit according to claim 1, wherein the channel is designed for transporting water.

20. An installation unit according to claim 1, comprising openings for attaching shower heads.

21. An installation unit according to claim 1, wherein the channel is designed for accommodating at least one of a hose and a line.

22. An installation unit according to claim 1, wherein at least one said hygienic article comprises a dispenser.

23. An installation unit according to claim 22, wherein the material to be dispensed is transported through the channel by a line.

24. An installation unit according to claim 23, wherein the channel serves as a reservoir for at least part of the material to be dispensed and the dispenser is arranged in an opening that is connected to the channel.

25. An installation unit according to claim 1, wherein at least one of the articles to be held comprises a lamp.

* * * * *